US005767052A

United States Patent [19]

Shaw, Jr. et al.

[11] Patent Number: 5,767,052

[45] Date of Patent: Jun. 16, 1998

[54] STABILIZED LIQUID FABRIC SOFTENER COMPOSITIONS

[75] Inventors: John Henry Shaw, Jr.; Robert Mermelstein, both of Cincinnati, Ohio

[73] Assignee: The Procter & Gamble Company, Cincinnati, Ohio

[21] Appl. No.: 789,547

[22] Filed: Jan. 27, 1997

Related U.S. Application Data

[63] Continuation of Ser. No. 372,490, Jan. 12, 1995, abandoned.

[51] Int. Cl.[6] ..... C11D 1/62

[52] U.S. Cl. ..... 510/329; 510/327; 510/328

[58] Field of Search ..... 510/327, 328, 510/329, 515

[56] References Cited

U.S. PATENT DOCUMENTS

| | | | |
|---|---|---|---|
| 2,926,154 | 2/1960 | Keim | 260/29.2 |
| 3,756,950 | 9/1973 | Gluck | 252/8.75 |
| 3,904,359 | 9/1975 | Ramachandran | 8/137 |
| 3,954,630 | 5/1976 | Ramachandran | 252/8.6 |
| 4,661,267 | 4/1987 | Dekker et al. | 252/8.8 |
| 4,702,857 | 10/1987 | Gosselink | 252/174.21 |
| 4,704,233 | 11/1987 | Hartman et al. | 252/527 |
| 4,711,730 | 12/1987 | Gosselink et al. | 252/8.75 |
| 4,749,596 | 6/1988 | Evans et al. | 427/242 |
| 4,810,413 | 3/1989 | Pancheri et al. | 252/174.12 |
| 4,818,569 | 4/1989 | Trinh et al. | 427/242 |
| 4,877,896 | 10/1989 | Maldonado et al. | 560/14 |
| 4,976,879 | 12/1990 | Maldonado et al. | 252/8.7 |
| 5,445,747 | 8/1995 | Kvietok et al. | 252/86 |

FOREIGN PATENT DOCUMENTS

| | | | |
|---|---|---|---|
| 913309 | 10/1972 | Canada | 8/93 |
| 0165138 | 12/1985 | European Pat. Off. | C11D 1/62 |
| 0168889 | 1/1986 | European Pat. Off. | C11D 3/36 |
| 0271004 | 6/1988 | European Pat. Off. | C11D 3/386 |
| 0 345 842 A2 | 12/1989 | European Pat. Off. | C11D 1/645 |
| 0345842 | 12/1989 | European Pat. Off. . | |
| 0458599 | 11/1991 | European Pat. Off. | C11D 3/00 |
| 0 462 806 A2 | 12/1991 | European Pat. Off. | C11D 3/40 |
| 0 462 806 A3 | 12/1991 | European Pat. Off. | C11D 3/00 |
| 0534009 | 3/1993 | European Pat. Off. | C11D 1/58 |
| 3312328 | 10/1984 | Germany | D06M 13/46 |
| HE16-128876 | 5/1994 | Japan | D06M 13/207 |
| 93/06294 | 4/1993 | WIPO | D06M 10/08 |

OTHER PUBLICATIONS

Hawley's Condensed Chemical Dictionary, 11th Edition, Van Nostrand Reinhold, New York, p. 1252.

AATCC Test Method—161–1992 "Chelating Agents: Disperse Dye Shade Change Caused by Metals; Control of", *AATCC Technical Manual* (1993), pp. 296–298. No month.

*Primary Examiner*—Michael Lewis
*Assistant Examiner*—Alexander G. Ghyka
*Attorney, Agent, or Firm*—Robert B. Aylor

[57] ABSTRACT

Concentrated liquid fabric softener compositions which are unstable due to phase separation are stabilized by means of water-soluble polyesters. Stable liquid compositions comprising various fabric treatment electrolytes are provided. Compositions comprising terephthalate-ethylene oxide stabilizers in fabric softener compositions comprising various chelators such as ethylenediamine disuccinate, diethylenetriamine pentaacetate and various aminophosphonates restore softness and dye colors to fabrics which have been exposed to metal cations, especially copper or nickel. Compositions comprising cellulase enzymes are also disclosed.

11 Claims, No Drawings

STABILIZED LIQUID FABRIC SOFTENER COMPOSITIONS

This is a continuation of application Ser. No. 08/372,490, filed on Jan. 12, 1995, now abandoned.

FIELD OF THE INVENTION

The present invention relates to fabric softener compositions which are stable in the presence of relatively high concentrations of electrolytes, and processes for their manufacture.

BACKGROUND OF THE INVENTION

The formulation of liquid fabric softener compositions typically involves the dispersion and suspension of organic cationic ingredients in a fluid carrier. Due to their physical-chemical properties, cationic softener ingredients typically exist in the fluid carrier in the form of vesicles, which are cationically charged. As a result of their charge, the vesicles tend to remain homogeneously dispersed in the carrier.

The formulation of conventional, "single strength" fabric softeners which generally comprise from about 5%–10% by weight of the cationic softener dispersed in water is fairly routine. However, the formulation of modern, concentrated liquid fabric softeners comprising up to about 30% of a cationic softener is not without difficulty. At the higher concentrations, viscosities can be difficult to control. Moreover it is usually desirable to incorporate materials other than the softener component into such compositions. For example, various inorganic electrolytes are conventionally used in such compositions at levels below about 1% to de-water the softener vesicles and to incorporate the perfume within the cationic vesicles, thus stabilizing the perfume. It is usually observed that the addition of more than about 1% electrolyte in the compositions can cause the vesicles to begin to coalesce and separate on storage, thus undesirably leading to a heterogeneous system.

Moreover, it would be desirable to include other water-soluble, charged electrolyte materials into concentrated fabric softener compositions to provide additional fabric care benefits. For example, various antimicrobial agents, chelating agents, and the like, would be useful to the consumer if they could be conveniently incorporated into stable, concentrated compositions. However, since the addition of such ingredients further increases the total electrolyte load on the system, they undesirably promote coalescence and separation of the softener vesicles It has now been determined that certain polymers can be incorporated into concentrated fabric softener compositions to enhance stability. While not intending to be limited by theory, it is speculated that such polymers somehow coat or otherwise interact with the cationic softener vesicles, thereby inhibiting their coalescence in the presence of high ionic strength. The polymer's presence in the system also stabilizes the viscosity of the bulk fluid. Stable systems are thereby provided.

Accordingly, it is an object of the present invention to provide a means for stabilizing dispersions of cationic fabric softeners in liquid carriers. It is another object herein to provide stabilized cationic fabric softener compositions which contain added electrolytes. It is still another object herein to provide concentrated fabric softener compositions which are storage stable and homogeneous. These and other objects are secured herein as will be seen from the following disclosures.

BACKGROUND ART

The use of various chelators and polycarboxy ingredients for several disclosed purposes in laundry rinse additives or other products appears in: U.S. Pat. Nos. 3,756,950; 3,904,359; 3,954,630; DE 3,312,328; EP 165,138 (85:12:18); EP 168,889 (86:01:22); EP 271,004 (88:06:15); EP 534,009 (93:03:31; WO 9,306,294); CA913,309 (00:01:00 priority 68:08:01 68CA-026,440); and JP HEI4 [1992] 275,956. The preferred EDDS chelator used herein is described in U.S. Pat. No. 4,704,233. Kymene is disclosed in U.S. Pat. No. 2,926,154. The preferred stabilizers are described in U.S. Pat. No. 4,702,857. See also Method AATCC-161-1992 "Chelating Agents: Disperse Dye Shade Change Caused by Metals; Control of".

SUMMARY OF THE INVENTION

The present invention encompasses a composition of matter, comprising:

(a) a stabilizing amount of a stabilizing agent which comprises a terephthalate/alkylene oxide copolymer.

(b) at least about 10%, by weight, of a fabric softener which is preferably cationic;

(c) greater than about 1%, by weight, total electrolyte; and (d) a fluid carrier comprising water.

Preferred concentrated compositions herein comprise from about 15% to about 35%, by weight, of the fabric softener and from about 0.2% to about 1%, by weight, of the stabilizing agent.

The compositions herein can include electrolytes which are members selected from the group consisting of water-soluble, inorganic salts. The electrolytes can also be water-soluble organic compounds which are members selected from the group consisting of chelating agents, strength maintenance agents, antimicrobials, chlorine scavengers (especially $NH_4Cl$), and mixtures thereof.

The compositions herein can also include cellulase enzymes, especially CAREZYME ex NOVO.

Highly preferred, concentrated compositions herein comprise:

(a) from about 0.2% to about 1%, by weight, of a stabilizer which is a copolymer derived from dimethyl terephthalate/1,2-propylene glycol/methyl capped ethylene oxide;

(b) from about 20% to about 30%, by weight, of a cationic fabric softener;

(c) electrolytes in an amount greater than about 1%, by weight, of composition, comprising $CaCl_2$ or $MgCl_2$, or mixtures thereof, and a water-soluble polycarboxylate or polyphosphonate chelator; and (d) a fluid carrier comprising water.

The invention also encompasses a method for stabilizing the liquid softener compositions containing electrolytes by admixing therewith a stabilizing agent which comprises a water-soluble polyester.

All percentages, ratios and proportions herein are by weight, unless otherwise specified. All documents cited are, in relevant part, incorporated herein by reference.

DETAILED DESCRIPTION OF THE INVENTION

The invention herein employs ingredients which are known and commercially available, or which can be synthesized in the manner described in the literature.

Stabilizing Agents—The stabilizing agents (stabilizers) used in the present invention can be prepared by art-recognized methods. The following illustrates this synthesis; more details can be found in U.S. Pat. No. 4,702,857, Gosselink, issued Oct. 27, 1987.

The stabilizers are water-soluble polyesters which can be formed from: (1) ethylene glycol, 1,2-propylene glycol or a mixture thereof; (2) a polyethylene glycol (PEG) capped at one end with a $C_1$–$C_4$ alkyl group; and (3) a dicarboxylic acid (or its diester). The respective amounts of these components are selected to prepare polyesters having the desired properties in terms of solubility and stabilizing properties.

The capped PEG used to prepare polyesters of the present invention is typically methyl capped and can be formed by ethoxylation of the respective alcohol with ethylene oxide. Also, methyl capped PEGs are commercially available from Union Carbide under the trade name Methoxy Carbowax and from Aldrich Chemical Company under the name poly (ethylene glycol)methyl ether. These commercial methyl capped PEGs have molecular weights of 350 (n=about 7.5), 550 (n=about 12), 750 (n=about 16), 1900 (n=about 43), and 5000 (n=about 113).

Preferably, the only dicarboxylic acid used is terephthalic acid or its diester. However, minor amounts of other aromatic dicarboxylic acids (or their diesters), or aliphatic dicarboxylic acids (or their diesters) can be included to the extent that the stabilizing properties are substantially maintained. Illustrative examples of other aromatic dicarboxylic acids which can be used include isophthalic acid, phthalic acid, naphthalene dicarboxylic acids, anthracene dicarboxylic acids, biphenyl dicarboxylic acids, oxydibenzoic acids and the like, as well as mixtures of these acids. Of aliphatic dicarboxylic acids are included: adipic, glutaric, succinic, trimethyladipic, pimelic, azelaic, sebacic, suberic, 1,4-cyclohexane dicarboxylic acid and/or dodecanedioic acids can be used.

The preferred method for preparing block polyesters used in the present invention comprises reacting the desired mixture of lower dialkyl esters (methyl, ethyl, propyl or butyl) of the dicarboxylic acid with a mixture of the glycol (ethylene glycol, 1,2-propylene glycol or a mixture thereof) and the capped PEG. The glycol esters and oligomers produced in this ester interchange reaction are then polymerized to the desired degree. The ester interchange reaction can be conducted in accordance with reaction conditions generally used for ester interchange reactions. This ester interchange reaction is usually conducted at temperatures of from 120° C. to 220° C. in the presence of an esterification catalyst. Alcohol is formed and constantly removed thus forcing the reaction to completion. The temperature and pressure of the reaction are desirably controlled so that glycol does not distill from the reaction mixture. Higher temperatures can be used if the reaction is conducted under pressure.

The catalysts used for the ester interchange reaction are those well known to the art. These catalysts include alkyl and alkaline earth metals, for example lithium, sodium, calcium, and magnesium, as well as transition and Group IIB metals, for example, antimony, manganese, cobalt, and zinc, usually as the respective oxides, carbonates and acetates. Typically, antimony trioxide and calcium acetate are used.

The extent of the ester interchange reaction can be monitored by the amount of alcohol liberated or the disappearance of the dialkyl esters of the dibasic acids in the reaction mixture as determined by high performance liquid chromatography (HPLC) or any other suitable method. The ester interchange reaction is desirably taken to more than 90% completion. Greater than 95% completion is preferred in order to decrease the amount of sublimates obtained in the polymerization step.

When the ester interchange reaction is complete, the glycol ester products are then polymerized to produce polyesters. The desired degree of polymerization can be determined by HPLC and $^{13}$C-NMR analysis. For commercial processes, the polymerization reaction is usually conducted at temperatures of from about 200° C. to about 280° C. in the presence of a catalyst. Higher temperatures can be used but tend to produce darker colored products. Illustrative examples of catalysts useful for the polymerization step include antimony trioxide, germanium dioxide, titanium alkoxide, hydrated antimony pentoxide, and ester interchange catalysts such as the salts of zinc, cobalt, and manganese. Excess glycol and other volatiles liberated during the reaction are removed under vacuum, as described by Gosselink.

The resulting, preferred polymer materials for use herein may be represented by the formula:

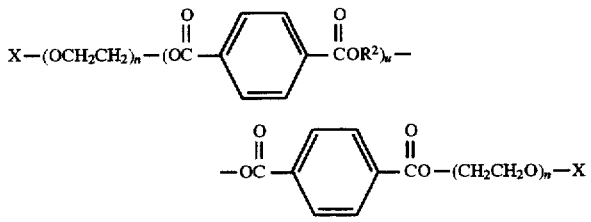

wherein $R^2$ is selected from the group consisting of 1,2-propylene (preferred), ethylene, or mixtures thereof; each X is $C_1$–$C_4$ alkyl (preferably methyl); each n is from about 12 to about 43; and u is from about 3 to about 10.

The storage stability of the compositions herein can be assessed by a simple visual test. The compositions are prepared, placed in clear containers, and allowed to stand undisturbed at any desired temperature. Since the vesicles of fabric softener are lighter than the aqueous carrier, the formation of a relatively clear phase at the bottom of the container will signify a stability problem. Stable compositions prepared in the present manner will withstand such a test for weeks, or even months, depending somewhat on temperature. Conversely, unstable compositions will usually exhibit phase separation in a matter of a few days, or less. Alternatively, stability can be assessed by measuring changes in viscosity after storage.

The stabilizer polymers are used herein in a "stabilizing amount", i.e., an amount sufficient to prevent the aforementioned phase separation, as well as unacceptable viscosity shifts in the finished product. This amount can vary somewhat, depending on the amount of cationic fabric softener, the amount of electrolyte, the level of cationic fabric softener and the level of electrolyte in the finished product, the type of electrolyte and the particular stabilizer polymer chosen. To illustrate this latter point, polyester stabilizers prepared in the manner of Gosselink and having about 3 terephthalate units and less than about 40 ethylene oxide units are somewhat less effective than those comprising about 5 terephthalate units and 40 EO units. Accordingly, a somewhat higher concentration of the less effective stabilizers would have to be used in a given circumstance to achieve the same stability benefits afforded by the preferred stabilizers.

The stability of the finished compositions can also be affected somewhat by the type of electrolyte or other ionic additives which may be present. However, this can be accounted for routinely by adjusting the level of stabilizer polymer. The following illustrates this in more detail. The composition being stabilized comprises 26% (wt.) ditallowalkyl ester of ethyldimethyl ammonium chloride and various ionic additives, as shown. The amount of the preferred 5 terephthalate/40 EO polyester required to stabilize the compositions is shown in Table 1.

TABLE 1

| Sample | Additive | $MgCl_2$ or $CaCl_2$ (%) | $ZnCl_2$, HCl, NaOH, $NH_4Cl$ (%) | Total Electrolyte (%) | % Stabilizer |
|---|---|---|---|---|---|
| 1 | 2.5% DETPA, DETMP or NTA* | 0.3–1 | 0.7–3.15 | 3.5–6.7 | 0.25–0.5 |
| 2 | 1.25% EDDS** | 0.5 | 0.75 | 2.5 | 0.5 |
| 3 | 0.5–1% KYMENE*** | 1 | 1.7 | 3.2–3.7 | 0.2–0.8 |

*Chelating agents, as described hereinafter
**Chelating agent, as described hereinafter
***Strength Maintenance Agent, as described hereinafter The stabilizers will typically comprise from about 0.1% to about 1.5%, by weight of the compositions herein. The compositions are stable on storage, and the amount of polyester plus other ingredients therein is typically sufficient to provide a preferred viscosity in the range of from about 30 cps to about 80 cps which remains stable over time (Brookfield LVT Viscometer; Spindle #2; 60 rpm; room temperature, ca. 25° C.).

Fabric Softeners/Anti-stats—The compositions and processes herein also contain one or more fabric softening or anti-static agents to provide additional fabric care benefits. Such ingredients will typically comprise from above about 10% up to about 35%, by weight, of the present composageons. The preferred fabric softening agents to be used in the present invention compositions are quaternary ammonium compounds or amine precursors herein having the formula (I) or (II), below.

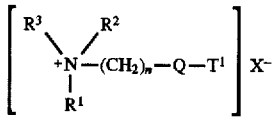

(I)

or

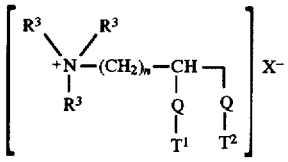

(II)

Q is —O—C(O)— or —C(O)—O— or —O—C(O)—O— or —$NR^4$—C(O)— or —C(O)—$NR^4$—; or mixtures thereof, e.g., an amide substituent and an ester substituent in the same molecule;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are (the same or different) $C_{11}$–$C_{22}$ alkyl or alkenyl;

n and m are integers from 1 to 4; and $X^-$ is a softener-compatible anion.

The alkyl, or alkenyl, chain $T^1$, $T^2$, $T^3$, $T^4$, $T^5$ must contain at least 11 carbon atoms, preferably at least 16 carbon atoms. The chain may be straight or branched.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quaternary ammonium compounds suitable for use in the aqueous fabric softening compositions herein include:

1) N,N-di(tallowyl-oxy-ethyl)-N,N-dimethyl ammonium chloride;
2) N,N-di(tallowyl-oxy-ethyl)-N-methyl, N-(2-hydroxyethyl) ammonium chloride or its corresponding amide (available as VARISOFT 222);
3) N,N-di(2-tallowyloxy-2-oxo-ethyl)-N,N-dimethyl ammonium chloride;
4) N,N-di(2-tallowyloxyethylcarbonyloxyethyl)-N,N-dimethyl ammonium chloride;
5)N-(2-tallowoyloxy-2-ethyl)-N-(2-tallowyloxy-2-oxo-ethyl)-N,N-dimethyl ammonium chloride;
6) N,N,N-tri(tallowyl-oxy-ethyl)-N-methyl ammonium chloride;
7) N-(2-tallowyloxy-2-oxoethyl)-N-(tallowyl-N,N-dimethyl-ammonium chloride; and
8) 1,2-ditallowyl oxy-3-trimethylammoniopropane chloride.;

and mixtures of any of the above materials.

Of these, compounds 1–7 are examples of compounds of Formula (I); compound 8 is a compound of Formula (II).

Particularly preferred is N,N-di(tallowoyl-oxy-ethyl)-N,N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having a IV of from 5 to 25, preferably 15 to 20, it has been found that a cis/trans isomer weight ratio greater than about 30/70, preferably greater than about 50/50 and more preferably greater than about 70/30 provides optimal concentratability.

For compounds of Formula (I) made from tallow fatty acids having a IV of above 25, the ratio of cis to trans isomers has been found to be less critical unless very high concentrations are needed.

Other examples of suitable quaternary ammoniums of Formula (I) and (II) are obtained by, e.g., replacing "tallow" in the above compounds with, for example, coco, palm, lauryl, oleyl, ricinoleoyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention.

By "amine precursors thereof" is meant the secondary or tertiary amines corresponding to the above quaternary ammonium compounds, said amines being substantially protonated in the present compositions due to the claimed pH values.

The quaternary ammonium or amine precursors compounds herein are present at levels of from about 1% to about 80% of compositions herein, depending on the composition execution which can be dilute with a preferred level of active from about 5% to about 15%, or concentrated, with a preferred level of active from about 15% to about 50%, most preferably about 15% to about 35%.

For many of the preceding fabric softening agents, the pH of the compositions herein is an essential parameter of the present invention. Indeed, pH influences the stability of the quaternary ammonium or amine precursors compounds, and of the cellulase, especially in prolonged storage conditions.

The pH, as defined in the present context, is measured in the neat compositions, or in the continuous phase after separation of the dispersed phase by ultra centrifugation, at 20° C. For optimum hydrolytic stability of compositions comprising softeners with ester linkages, the neat pH, measured in the above-mentioned conditions, must be in the range of from about 2.0 to about 4.5, preferably about 2.0 to about 3.5. The pH of such compositions herein can be regulated by the addition of a Bronsted acid. With non-ester softeners, the pH can be higher, typically in the 3.5 to 8.0 range.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Softening agents also useful in the present invention compositions are nonionic fabric softener materials, preferably in combination with cationic softening agents. Typically, such nonionic fabric softener materials have a HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

The level of optional nonionic softener in the compositions herein is typically from about 0.1% to about 10%, preferably from about 1% to about 5%.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from 1–3, preferably 1–2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between about 10:1 and about 1:10, and 1,5-sorbitan esters are also useful.

Glycerol and polyglycerol esters, especially glycerol, diglycerol, triglycerol, and polyglycerol mono- and/or di-esters are preferred herein (e.g. polyglycerol monostearate with a trade name of Radiasurf 7248).

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Additional fabric softening agents useful herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Burns, issued Mar. 27, 1984; and in U.S. Pat. Nos.: 3,861,870, Edwards and Diehl; 4,308,151, Cambre; 3,886,075, Bernardino; 4,233,164, Davis; 4,401,578, Verbruggen; 3,974,076, Wiersema and Rieke; and 4,237,016, Rudkin, Clint, and Young, all of said patents being incorporated herein by reference.

For example, suitable fabric softener agents useful herein may comprise one, two, or all three of the following fabric softening agents:

(a) the reaction product of higher fatty acids with a polyamine selected from the group consisting of hydroxyalkylalkylenediamines and dialkylenetriamines and mixtures thereof (preferably from about 10% to about 80%); and/or (b) cationic nitrogenous salts containing only one long chain acyclic aliphatic $C_{15}$–$C_{22}$ hydrocarbon group (preferably from about 3% to about 40%); and/or (c) cationic nitrogenous salts having two or more long chain acyclic aliphatic $C_{15}$–$C_{22}$ hydrocarbon groups or one said group and an arylalkyl group (preferably from about 10% to about 80%); with said (a), (b) and (c) preferred percentages being by weight of the fabric softening agent component of the present invention compositions.

Following are the general descriptions of the preceding (a), (b), and (c) softener ingredients (including certain specific examples which illustrate, but do not limit the present invention).

Component (a): Softening agents (actives) of the present invention may be the reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyamines.

The preferred Component (a) is a nitrogenous compound selected from the group consisting of the reaction product mixtures or some selected components of the mixtures. More specifically, the preferred Component (a) is compounds selected from the group consisting of:

(i) the reaction product of higher fatty acids with hydroxy alkylalkylenediamines in a molecular ratio of about 2:1, said reaction product containing a composition having a compound of the formula:

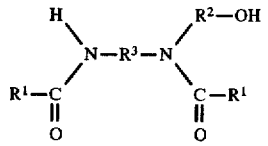

wherein $R^1$ is an acyclic aliphatic $C_{15}$–$C_{21}$ hydrocarbon group and $R^2$ and $R^3$ are divalent $C_1$–$C_3$ alkylene groups;

(ii) substituted imidazoline compounds having the formula:

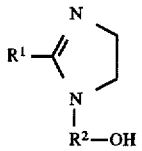

wherein $R^1$ and $R^2$ are defined as above;

(iii) substituted imidazoline compounds having the formula:

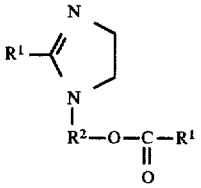

wherein $R^1$ and $R^2$ are defined as above;

(iv) the reaction product of higher fatty acids with di alkylenetriamines in a molecular ratio of about 2:1, said reaction product containing a composition having a compound of the formula:

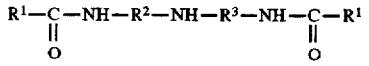

wherein $R^1$, $R^2$ and $R^3$ are defined as above; and (v) substituted imidazoline compounds having the formula:

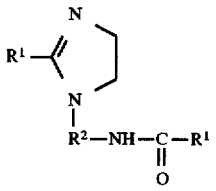

wherein $R^1$ and $R^2$ are defined as above; and (vi) mixtures thereof.

Component (a)(i) is commercially available as Mazamide® 6, sold by Mazer Chemicals, or Ceranine® HC, sold by Sandoz Colors & Chemicals; here the higher fatty acids are hydrogenated tallow fatty acids and the hydroxyalkylalkylenediamine is N-2-hydroxyethylethylenediamine, and $R^1$ is an aliphatic $C_{15}$–$C_{17}$ hydrocarbon group, and $R^2$ and $R^3$ are divalent ethylene groups.

An example of Component (a)(ii) is stearic hydroxyethyl imidazoline wherein $R^1$ is an aliphatic $C_{17}$ hydrocarbon group, $R^2$ is a divalent ethylene group; this chemical is sold under the trade names of Alkazine® ST by Alkaril Chemicals, Inc., or Schercozoline® S by Scher Chemicals, Inc.

An example of Component (a)(iv) is N,N"-ditallowalkoyldiethylenetriamine where $R^1$ is an aliphatic $C_{15}$–$C_{17}$ hydrocarbon group and $R^2$ and $R^3$ are divalent ethylene groups.

An example of Component (a)(v) is 1-tallowamidoethyl-2-tallowimidazoline wherein $R^1$ is an aliphatic $C_{15}$–$C_{17}$ hydrocarbon group and $R^2$ is a divalent ethylene group.

The Components (a)(iii) and (a)(v) can also be first dispersed in a Bronsted acid dispersing aid having a pKa value of not greater than about 4; provided that the pH of the final composition is not greater than about 5. Some preferred dispersing aids are hydrochloric acid, phosphoric acid, or methylsulfonic acid.

Both N,N"-ditallowalkoyldiethylenetriamine and 1-tallow(amido ethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N,N"-ditallowalkoyldiethylenetriamine and 1-tallowamido-ethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Varisoft® 475.

Component (b): The preferred Component (b) is a cationic nitrogenous salt containing one long chain acyclic aliphatic $C_{15}$–$C_{22}$ hydrocarbon group selected from the group consisting of:

(i) acyclic quaternary ammonium salts having the formula:

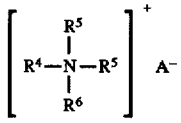

wherein $R^4$ is an acyclic aliphatic $C_{15}$–$C_{22}$ hydrocarbon group, $R^5$ and $R^6$ are $C_1$–$C_4$ saturated alkyl or hydroxy alkyl groups, and A– is an anion;

(ii) substituted imidazolinium salts having the formula:

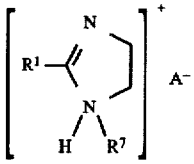

wherein $R^1$ is an acyclic aliphatic $C_{15}$–$C_{21}$ hydrocarbon group, $R^7$ is a hydrogen or a $C_1$–$C_4$ saturated alkyl or hydroxyalkyl group, and A– is an anion;

(iii) substituted imidazolinium salts having the formula:

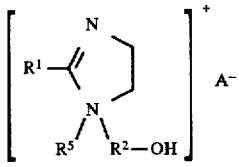

wherein $R^2$ is a divalent $C_1$–$C_3$ alkylene group and $R^1$, $R^5$ and A– are as defined above;

(iv) alkylpyridinium salts having the formula:

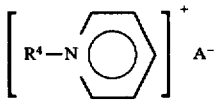

wherein $R^4$ is an acyclic aliphatic $C_{16}$–$C_{22}$ hydrocarbon group and A– is an anion; and (v) alkanamide alkylene pyridinium salts having the formula:

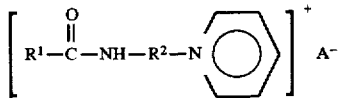

wherein $R^1$ is an acyclic aliphatic $C_{15}$–$C_{21}$ hydrocarbon group, $R^2$ is a divalent $C_1$–$C_3$ alkylene group, and A– is an ion group;

(vi) monoester quaternary ammonium compounds having the formula:

$$[(R)_3—N^+—(CH_2)_n—Y—R^2]\ A-$$

wherein each Y=—O—(O)C—, or —C(O)—O—;

each n=1 to 4;

each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl or mixtures thereof;

$R^2$ is a $C_{10}$–$C_{22}$ hydrocarbyl, or substituted hydrocarbyl, substituent, preferably $C_{12}$–$C_{19}$ alkyl and/or alkenyl, most preferably $C_{12}$–$C_{18}$ straight chain alkyl and/or alkenyl (the shorter chains being more stable in the formulations); and the counterion, A–, can be any softener-compatible anion, for example, chloride, bromide, methylsulfate, formate, sulfate, nitrate and the like; and (vii) mixtures thereof Examples of Component (b)(i) are the monoalkyltrimethylammonium salts such as monotallowtrimethylammonium chloride, mono(hydrogenated tallow) trimethylammonium chloride, palmityltrimethyl ammonium chloride and soyatrimethylammonium chloride, sold by Sherex Chemical Company under the trade name Adogen® 471, Adogen® 441, Adogen® 444, and Adogen® 415, respectively. In these salts, $R^4$ is an acyclic aliphatic $C_{16}$–$C_{18}$ hydrocarbon group, and $R^5$ and $R^6$ are methyl groups. Mono(hydrogenated tallow)trimethylammonium chloride and monotallowtrimethylammonium chloride are preferred.

Other examples of Component (b)(i) are behenyltrimethylammonium chloride wherein $R^4$ is a $C_{22}$ hydrocarbon group and sold under the trade name Kemamine® Q2803C by Humko Chemical Division of Witco Chemical Corporation; soyadimethylethylammonium ethylsulfate wherein $R^4$ is a $C_{16}$–$C_{18}$ hydrocarbon group, $R^5$ is a methyl group, $R^6$ is an ethyl group, and A– is an ethylsulfate anion, sold under the trade name Jordaquat® 1033 by Jordan Chemical Company; and methyl-bis(2-hydroxyethyl)-octadecylammonium chloride wherein $R^4$ is a $C_{18}$ hydrocarbon group, $R^5$ is a 2-hydroxyethyl group and $R^6$ is a methyl group and available under the trade name Ethoquad® 18/12 from Armak Company.

An example of Component (b)(iii) is 1-ethyl-1-(2-hydroxy ethyl)-2-isoheptadecylirnidazolinium ethylsulfate wherein $R^1$ is a $C_{17}$ hydrocarbon group, $R^2$ is an ethylene group, $R^5$ is an ethyl group, and A– is an ethylsulfate anion. It is available from Mona Industries, Inc., under the trade name Monaquat® ISIES.

An example of Component (b)(vi) is mono (tallowoyloxyethyl) hydroxyethyldimethylammonium chloride, i.e., monoester of tallow fatty acid with di(hydroxyethyl)dimethylammonium chloride, a by-product in the process of making diester of tallow fatty acid with di(hydroxyethyl)dimethylammonium chloride, i.e., di(tallowoyloxyethyl)dimethylammonium chloride, a (c) (vii) component (vide infra).

Component (c): Preferred cationic nitrogenous salts having two or more long chain acyclic aliphatic $C_{15}$–$C_{22}$ hydrocarbon groups or one said group and an arylalkyl group which can be used either alone or as part of a mixture are selected from the group consisting of:

(i) acyclic quaternary ammonium salts having the formula:

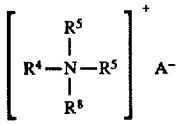

wherein $R^4$ is an acyclic aliphatic $C_{15}$–$C_{22}$ hydrocarbon group, $R^5$ is a $C_1$–$C_4$ saturated alkyl or hydroxyalkyl group, $R^8$ is selected from the group consisting of $R^4$ and $R^5$ groups, and A– is an anion defined as above;

(ii) diamido quaternary ammonium salts having the formula:

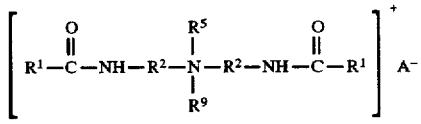

wherein $R^1$ is an acyclic aliphatic $C_{15}$–$C_{21}$ hydrocarbon group, $R^2$ is a divalent alkylene group having 1 to 3 carbon atoms, $R^5$ and $R^9$ are $C_1$–$C_4$ saturated alkyl or hydroxyalkyl groups, and A– is an anion;

(iii) diamino alkoxylated quaternary ammonium salts having the formula:

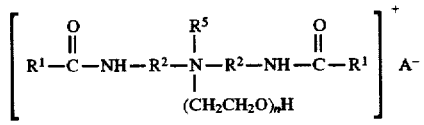

wherein n is equal to 1 to about 5, and $R^1$, $R^2$, $R^5$ and A– are as defined above;

(iv) quaternary ammonium compounds having the formula:

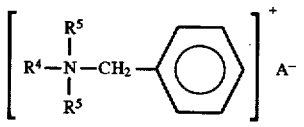

wherein $R^4$ is an acyclic aliphatic $C_{15}$–$C_{22}$ hydrocarbon group, $R^5$ is a $C_1$–$C_4$ saturated alkyl or hydroxyalkyl group, A– is an anion;

(v) substituted imidazolinium salts having the formula:

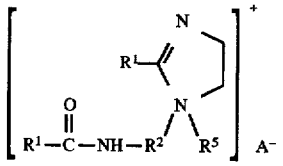

wherein $R^1$ is an acyclic aliphatic $C_{15}$–$C_{21}$ hydrocarbon group, $R^2$ is a divalent alkylene group having 1 to 3 carbon atoms, and $R^5$ and A– are as defined above; and (vi) substituted imidazolinium salts having the formula:

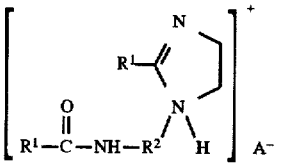

wherein $R^1$, $R^2$ and A– are as defined above;

(vii) diester quaternary ammonium (DEQA) compounds having the formula:

$$(R)_{4-m}—N^+—[(CH_2)_n—Y—R^2]_m A^-$$

wherein each Y=—O—(O)C—, or —C(O)—O—;

m=2 or 3;

each n=1 to 4;

each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl, or mixtures thereof;

each $R^2$ is a long chain $C_{10}$–$C_{22}$ hydrocarbyl, or substituted hydrocarbyl substituent, preferably $C_{15}$–$C_{19}$ alkyl and/or alkenyl, most preferably $C_{15}$–$C_{18}$ straight chain alkyl and/or alkenyl; and the counterion, A–, can be any softener-compatible anion, for example, chloride, bromide, methylsulfate, formate, sulfate, nitrate and the like; and (viii) mixtures thereof Examples of Component (c)(i) are the well-known dialkyldimethylammonium salts such as ditallowdimethylammonium chloride, ditallowdimethylammonium methylsulfate, di(hydrogenated tallow)di methylammonium chloride, distearyldimethylammonium chloride, dibehenyldimethylammonium chloride. Di(hydrogenated tallow)di methylammonium chloride and ditallowdimethylammonium chloride are preferred. Examples of commercially available dialkyldimethyl ammonium salts usable in the present invention are di(hydrogenated tallow)dimethylammonium chloride (trade name Adogen® 442), ditallowdimethylammonium chloride (trade name Adogen® 470), distearyl dimethylammonium chloride (trade name Arosurf® TA-100), all available from Witco Chemical Company. Dibehenyldimethylammonium chloride wherein $R^4$ is an acyclic aliphatic $C_{22}$ hydrocarbon group is sold under the trade name Kemamine Q-2802C by Humko Chemical Division of Witco Chemical Corporation.

Examples of Component (c)(ii) are methylbis(tallowamido ethyl)(2-hydroxyethyl)ammonium methylsulfate and methylbis(hydrogenated tallowamidoethyl)(2-hydroxyethyl)ammonium methylsulfate wherein $R^1$ is an acyclic aliphatic $C_{15}$–$C_{17}$ hydrocarbon group, $R^2$ is an ethylene group, $R^5$ is a methyl group, $R^9$ is a hydroxyalkyl group and A– is a methylsulfate anion; these materials are available from Witco Chemical Company under the trade names Varisoft® 222 and Varisoft® 110, respectively.

An example of Component (c)(iv) is dimethylstearylbenzyl ammonium chloride wherein $R^4$ is an acyclic aliphatic $C_{18}$ hydrocarbon group, $R^5$ is a methyl group and A– is a chloride anion, and is sold under the trade names Varisoft® SDC by Witco Chemical Company and Ammonyx® 490 by Onyx Chemical Company.

Examples of Component (c)(v) are 1-methyl-1-tallowamido ethyl-2-tallowimidazolinium methylsulfate and 1-methyl-1-(hydrogenated tallowamidoethyl)-2-(hydrogenated tallow)imidazolinium methylsulfate wherein $R^1$ is an acyclic aliphatic $C_{15}$–$C_{17}$ hydrocarbon group, $R^2$ is an ethylene group, $R^5$ is a methyl group and A– is a chloride anion; they are sold under the trade names Varisoft® 475 and Varisoft® 445, respectively, by Witco Chemical Company.

It will be understood that for (c)(vii) above substituents R and $R^2$ can optionally be substituted with various groups such as alkoxyl or hydroxyl groups, and/or can be saturated, unsaturated, straight, and/or branched so long as the $R^2$ groups maintain their basically hydrophobic character. Preferred softening compounds are biodegradable such as those in Component (c)(vii). These preferred compounds can be considered to be diester variations of ditallow dimethyl ammonium chloride (DTDMAC), which is a widely used fabric softener.

The following are non-limiting examples of (c)(vii) (wherein all long-chain alkyl substituents are straight-chain):

$[CH_3]_2{}^+N[CH_2CH_2OC(O)R^2]_2\,Cl^-$ $[HOCH(CH_3)CH_2][CH_3]\,{}^+N[CH_2CH_2OC(O)C_{15}H_{31}]_2\,Br^-$ $[C_2H_5]_2\,{}^+N[CH_2CH_2OC(O)C_{17}H_{35}]_2\,Cl^-$ $[CH_3][C_2H_5]\,{}^+N[CH_2CH_2OC(O)C_{13}H_{27}]_2\,I^-$ $[C_3H_7][C_2H_5]\,{}^+N[CH_2CH_2OC(O)C_{15}H_{31}]_2\,{}^-SO_4CH_3$ $[CH_3]_2\,{}^+N—CH_2CH_2OC(O)C_{15}H_{31}\,Cl^-$
$\quad\quad | $
$\quad\quad CH_2CH_2OC(O)C_{17}H_{35}$ $[CH_2CH_2OH][CH_3]\,{}^+N[CH_2CH_2OC(O)R^2]_2\,Cl^-$ where —C(O)$R^2$ is derived from soft tallow and/or hardened tallow fatty acids. Especially preferred is diester of soft and/or hardened tallow fatty acids with di(hydroxyethyl) dimethylammonium chloride, also called di(tallowoyloxyethyl)di-methylammonium chloride.

Since some of the foregoing compounds (diesters) are somewhat labile to hydrolysis, they should be handled rather carefully when used to formulate the compositions herein. For example, stable liquid compositions herein are formulated at a pH in the range of about 2 to about 5, preferably from about 2 to about 4.5, more preferably from about 2 to about 4. The pH can be adjusted by the addition of a Bronsted acid. Ranges of pH for making stable softener compositions containing diester quaternary ammonium fabric softening compounds are disclosed in U.S. Pat. No. 4,767,547, Straathof and Konig, issued Aug. 30, 1988, and is incorporated herein by reference.

The diester quaternary ammonium fabric softening compound (DEQA) of (c)(vii) can also have the general formula:

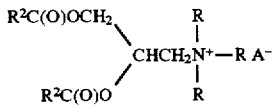

wherein each R, $R^2$, and A– have the same meanings as before. Such compounds include those having the formula:

$$[CH_3]_3\ {}^{+}N[CH_2CH(CH_2OC(O)R^2)OC(O)R^2]\ Cl^{31}$$

where —OC(O)$R^2$ is derived from soft tallow and/or hardened tallow fatty acids.

Preferably each R is a methyl or ethyl group and preferably each $R^2$ is in the range of $C_{15}$ to $C_{19}$. Degrees of branching, substitution and/or non-saturation can be present in the alkyl chains. The anion A– in the molecule is preferably the anion of a strong acid and can be, for example, chloride, bromide, sulphate, and methyl sulphate; the anion can carry a double charge in which case A– represents half a group. These compounds, in general, are more difficult to formulate as stable concentrated liquid compositions.

These types of compounds and general methods of making them are disclosed in U.S. Pat. No. 4,137,180, Naik et al., issued Jan. 30, 1979, which is incorporated herein by reference.

A preferred composition contains Component (a) at a level of from about 10% to about 80%, Component (b) at a level of from about 3% to about 40%, and Component (c) at a level of from about 10% to about 80%, by weight of the fabric softening component of the present invention compositions. A more preferred composition contains Component (c) which is selected from the group consisting of. (i) di(hydrogenated tallow)dimethylammonium chloride; (v) methyl-1-tallowamidoethyl-2-tallowimidazolinium methylsulfate; (vii) ditallowylethanol ester dimethylammonium chloride; and mixtures thereof An even more preferred composition contains Component (a): the reaction product of about 2 moles of hydrogenated tallow fatty acids with about 1 mole of N-2-hydroxyethylethylenediamine and is present at a level of from about 20% to about 70% by weight of the fabric softening component of the present invention compositions; Component (b): mono(hydrogenated tallow)trimethyl ammonium chloride present at a level of from about 3% to about 30% by weight of the fabric softening component of the present invention compositions; Component (c): selected from the group consisting of di(hydrogenated tallow) dimethylammonium chloride, ditallowdimethylammonium chloride, methyl-1-tallowamidoethyl-2-tallowimidazolinium methylsulfate, diethanol ester dimethylammonium chloride, and mixtures thereof; wherein Component (c) is present at a level of from about 20% to about 60% by weight of the fabric softening component of the present invention compositions; and wherein the weight ratio of said di(hydrogenated tallow)dimethylammonium chloride to said methyl-1-tallowamido ethyl-2-tallowimidazolinium methylsulfate is from about 2:1 to about 6:1.

The above individual components can also be used individually, especially those of I(c) (e.g., ditallowdimethylammonium chloride or ditallowylethanol ester dimethylammonium chloride).

In the cationic nitrogenous salts described hereinbefore, the anion A– provides charge neutrality. Most often, the anion used to provide charge neutrality in these salts is a halide, such as chloride or bromide. However, other anions can be used, such as methylsulfate, ethylsulfate, hydroxide, acetate, formate, citrate, sulfate, carbonate, and the like. Chloride and methylsulfate are preferred herein as anion A–. The fabric softeners may be milled using conventional high shear milling equipment to further increase product stability and softening efficacy due to the reduction of vesicle sizes in the finished product. Milled particles of 1 micron or less are preferred.

Chelating Agents—The stabilized compositions and processes herein preferably employ one or more copper and/or nickel chelating agents ("chelators"). Such water-soluble chelating agents can be selected from the group consisting of amino carboxylates, amino phosphonates, polyfunctionally-substituted aromatic chelating agents and mixtures thereof, all as hereinafter defined. Without intending to be bound by theory, it is believed that the benefit of these materials is due in part to their exceptional ability to remove copper and nickel ions from rinse solutions by formation of soluble chelates. Surprisingly, these chelating agents also appear to interact with dyes and optical brighteners on fabrics which have already been undesirably affected by interactions with copper or nickel cations (or other cations such as manganese, iron or transition metals) in the laundry process, with the attendant color change and/or drabness effects. By contact with the chelators, the whiteness and/or brightness of such affected fabrics are substantially improved or restored.

Amino carboxylates useful as chelating agents herein include ethylenediaminetetraacetates (EDTA), N-hydroxyethylethylenediaminetriacetates, nitrilotriacetates (NTA), ethylenediamine tetraproprionates, ethylenediamine-N,N'-diglutamates, 2-hyroxypropylenediamine-N,N'-disuccinates, triethylenetetraamine-hexacetates, diethylenetriaminepentaacetates (DETPA), and ethanoldiglycines, including their water-soluble salts such as the alkali metal, ammonium, and substituted ammonium salts thereof and mixtures thereof Amino phosphonates are also suitable for use as chelating agents in the compositions of the invention when at least low levels of total phosphorus are permitted in detergent compositions, and include ethylenediaminetetrakis (methylenephosphonates), diethylenetriamine-N,N,N',N", N"-pentakis(methanephosphonate)(DETMP) and 1-hydroxyethane-1,1-diphosphonate (HEDP). Preferably, these amino phosphonates to not contain alkyl or alkenyl groups with more than about 6 carbon atoms.

The chelating agents are typically used in the present rinse process at levels from about 2 ppm to about 25 ppm, for periods from 1 minute up to several hours' soaking.

The preferred EDDS chelator used herein (also known as ethylenediamine-N,N'-disuccinate) is the material described in U.S. Pat. No. 4,704,233, cited hereinabove, and has the formula (shown in free acid form):

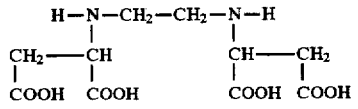

As disclosed in the patent, EDDS can be prepared using maleic anhydride and ethylenediamine. The preferred biodegradable [S,S] isomer of EDDS can be prepared by reacting L-aspartic acid with 1,2-dibromoethane. The EDDS has advantages over other chelators in that it is effective for chelating both copper and nickel cations, is available in a biodegradable form, and does not contain phosphorus. The EDDS employed herein as a chelator is typically in its salt form, i.e., wherein one or more of the four acidic hydrogens are replaced by a water-soluble cation M, such as sodium, potassium, ammonium, triethanolammonium, and the like. As noted before, the EDDS chelator is also typically used in the present rinse process at levels from about 2 ppm to about 25 ppm for periods from 2 minutes up to several hours' soaking. As noted hereinafter, at certain pH's the EDDS is preferably used in combination with zinc cations.

As can be seen from the foregoing, a wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. The chelators will comprise at least about 0.5%, typically from about 0.75% to about 15%, preferably from about 1% to about 5%, by weight of the compositions herein. Preferred chelators include DETMP, DETPA, NTA, EDDS or mixtures thereof Chlorine Scavenger—Chlorine is used in many parts of the world to sanitize water. To ensure that the water is safe, a small residual amount, typically about 1 to 2 parts per million (ppm), of chlorine is left in the water. At least about 10% of U.S. households has about 2 ppm or more of chlorine in its tap water at some time. It has been found that this small amount of chlorine in the tap water can also contribute to fading or color changes of some fabric dyes. Thus, chlorine-induced fading of fabric colors over time can result from the presence of residual chlorine in the rinse water. Accordingly, the stabilized compositions of the present invention may also include a chlorine scavenger. Moreover, the use of such chlorine scavengers provides a secondary benefit due to their ability to eliminate or reduce the chlorine odor on fabrics.

Chlorine scavengers are materials that react with chlorine, or with chlorine-generating materials, such as hypochlorite, to eliminate or reduce the bleaching activity of the chlorine materials. For color fidelity purposes, it is generally suitable to incorporate enough chlorine scavenger to neutralize about 1–10 ppm chlorine in rinse water, typically to neutralize at least about 1 ppm in rinse water. For the additional elimination or reduction of fabric chlorine odor resulting from the use of a chlorine bleach in the wash, the compositions should contain enough chlorine scavenger to neutralize at least about 10 ppm in rinse water.

Such compositions according to the present invention provide about 0.1 ppm to about 40 ppm, preferably from about 0.2 ppm to about 20 ppm, and more preferably from about 0.3 ppm to about 10 ppm of chlorine scavenger to an average rinse bath. Suitable levels of chlorine scavengers in the compositions of the present invention range from about 0.01% to about 10%, preferably from about 0.02% to about 5%, most preferably from about 0.03% to about 4%, by weight of total composition. If both the cation and the anion of the scavenger react with chlorine, which is desirable, the level may be adjusted to react with an equivalent amount of available chlorine.

Non-limiting examples of chlorine scavengers include primary and secondary amines, including primary and secondary fatty amines; ammonium salts, e.g., chloride, sulfate; amine-functional polymers; amino acid homopolymers with amino groups and their salts, such as polyarginine, polylysine, polyhistidine; amino acid copolymers with amino groups and their salts; amino acids and their salts, preferably those having more than one amino group per molecule, such as arginine, histidine, not including lysine reducing anions such as sulfite, bisulfite, thiosulfate, nitrite; antioxidants such as ascorbate, carbamate, phenols; and mixtures thereof. Ammonium chloride is a preferred inexpensive chlorine scavenger for use herein.

Other useful chlorine scavengers include water-soluble, low molecular weight primary and secondary amines of low volatility, e.g., monoethanolamine, diethanolamine, tris (hydroxymethyl)aminomethane, hexamethylenetetramine. Suitable amine-functional chlorine scavenger polymers include: water-soluble polyethyleneimines, polyamines, polyvinylamines, polyamineamides and polyacrylamides. The preferred polymers are polyethyleneimines, the polyamines, and polyamineamides. Preferred polyethyleneimines have a molecular weight of less than about 2000, more preferably from about 200 to about 1500.

Strength Maintenance Agents—As is well-known, fabrics may be damaged by mechanical forces and various chemicals. In particular, cellulosic fibers such as cotton are known to degrade into fibrils and microfibrils, which eventually break and cause a fabric to appear "worn". It has now been discovered that certain materials, especially KYMENE, can be stably incorporated into the present compositions. On contact with the fibrils and microfibrils, the KYMENE appears to provide a cross-lining effect, thereby helping to restore strength before the fibril breaks.

KYMENE is a polyamidepolyamine/epichlorohydrin material of the type described in U.S. Pat. No. 2,926,154 (2/23/60; to G. I. Keim), which can be referred to for details. See also U.S. Pat. No. 5,200,036. If used, it will comprise at least about 0.1%, typically from about 0.1% to about 1.5%, preferably from about 0.5% to about 1%, by weight of the compositions herein.

Dye Transfer Inhibiting Agents—The stabilized compositions of the present invention may also include one or more materials effective for inhibiting the transfer of dyes from one fabric to another during the rinsing process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R—$A_x$—Z; wherein Z is a polymerizable unit to which an N—O group can be attached or the N—O group can form part of the polymerizable unit or the N—O group can be attached to both units; A is one of the following structures: —NC(O)—, —C(O)O—, —S—, —O—, —N=; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

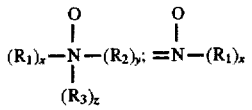

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa <10, preferably pKa <7, more preferred pKa <6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the rinse added compositions and processes herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113, "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The compositions herein may also optionally contain from about 0.005% to 5% by weight of certain types of hydrophilic optical brighteners which also provide a dye transfer inhibition action. If used, the compositions herein will preferably comprise from about 0.001% to 1% by weight of such optical brighteners.

The hydrophilic optical brighteners useful in the present invention are those having the structural formula:

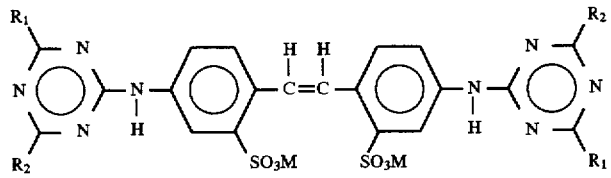

wherein $R^1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the rinse added compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous solutions than does either of these two components when used alone. Without being bound by theory, it is believed that such brighteners work this way because they have high affinity for fabrics in the aqueous solution and therefore deposit relatively quick on fabrics. The extent to which brighteners deposit on fabrics in solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally also be used in the present compositions to provide conventional fabric "brightness" benefits, rather than a true dye transfer inhibiting effect.

Cellulase Enymes—Cellulase enzymes can also contribute to overall fabric appearance improvements and can optionally be used in the present compositions. A wide variety of cellulase enzymes are known from the detergency, food and papermaking arts.

The cellulases usable in the compositions and processes herein can be any bacterial or fungal cellulase. Suitable cellulases are disclosed, for example, in GB-A-2 075 028, GB-A-2 095 275 and DE-OS-24 47 832, all incorporated herein by reference in their entirety.

Examples of such cellulases are cellulase produced by a strain of Humicola insolens (Humicola grisea var. thermoidea), particularly by the Humicola strain DSM 1800, and cellulase 212-producing fungus belonging to the genus Aeromonas, and cellulase extracted from the hepatopancreas of a marine mullosc (Dolabella Auricula Solander).

The cellulase added to the composition of the invention may be in the form of a non-dusting granulate, e.g. "marumes" or "prills", or in the form of a liquid, e.g., one in which the cellulase is provided as a cellulase concentrate suspended in e.g. a nonionic surfactant or dissolved in an aqueous medium. Preferred cellulases for use herein are characterized in that they provide at least 10% removal of immobilized radioactive labelled carboxymethyl-cellulose according to the $C^{14}$CMC-method described in EPA 350 098 (incorporated herein by reference in its entirety) at $25\times10^{-6}$% by weight of cellulase protein in the laundry test solution.

Most preferred cellulases are those as described in International Patent Application WO91/17243, incorporated herein by reference in its entirety. For example, a cellulase preparation useful in the compositions of the invention can consist essentially of a homogeneous endoglucanase component, which is immunoreactive with an antibody raised against a highly purified 43 kD) cellulase derived from *Humicola insolens*, DSM 1800, or which is homologous to said 43 kD endoglucanase.

The cellulases herein should be used in the compositions of the present invention at a level equivalent to an activity from about 0.1 to about 125 CEVU/gram of composition [CEVU=Cellulase (equivalent) Viscosity Unit, as described, for example, in WO 91/13136, incorporated herein by reference in its entirety], and most preferably about 5 to about 100. Such levels of cellulase are selected to provide the herein preferred cellulase activity at a level such that the compositions deliver an appearance-enhancing and/or fabric softening amount of cellulase below about 50 CEVU's per liter of rinse solution, preferably below about 30 CEVU's per liter, more preferably below about 25 CEVU's per liter, and most preferably below about 20 CEVU's per liter, during the rinse cycle of a machine washing process. Preferably, the present invention compositions are used in the rinse cycle at a level to provide from about 1 CEVU's per liter rinse solution to about 50 CEVU's per liter rinse solution, more preferably from about 2 CEVU's per liter to about 30 CEU's per liter, even more preferably from about 5 CEVU's per liter to about 25 CEVU's per liter, and most preferably from about 5 CEVU's per liter to about 15 CEVU's per liter.

The CAREZYME and BAN cellulases, such as those available from NOVO, are especially useful herein. If used, such commercial enzyme preparations will typically comprise from about 0.001% to about 2%, by weight, of the present compositions.

The compositions of the present invention are provided in liquid form for use in an aqueous bath. Water or water/alcohol is a typical carrier for liquid compositions and will generally comprise up to about 89%, by weight, of the compositions herein. The compositions may conveniently be formulated over the pH range of from about 3 to about 8. On dilution in the bath, the in-use pH will typically be in the range of about 6.0–6.5. It is to be understood that the formulation of liquid compositions comprising EDDS with the degradable (typically, ester containing) fabric softeners is not entirely routine, since a low product pH, generally in the range of 3.0–3.5, is required for optimal storage stability of the degradable softeners. Under such low pH conditions, the EDDS tends to form needle-like crystals in the compositions. If desired, such compositions can be adjusted to a pH as high as about 4.5 to re-solubilize the EDDS. However, at this pH range the overall storage stability of the product will be compromised.

It has now been discovered that liquid compositions comprising EDDS at pH's in the acidic range of 3.0 to 3.5 can be formulated by providing zinc cations in the compositions, e.g., by the addition of water-soluble zinc salts. In particular, zinc chloride, but also $ZnBr_2$ and $ZnSO_4$ can be used for this purpose. The mole ratio of zinc cation to EDDS is typically in the range from about 1:1 to about 2:1, preferably about 3:2. Thus, when properly formulated in the manner described hereinafter, the formation of EDDS needles will be minimized.

The following illustrates compositions and processes according to the present invention, but is not intended to be limiting thereof

EXAMPLE I

DEEDMAC (ditallowalkyl ester of ethyldimethyl ammonium chloride; mainly dimethyl bis (stearoyl oxy ethyl) ammonium chloride) stock is liquefied in a 76° C. water bath. Separately, the free water in the composition, also containing silicone anti-foam agent and about 0.02 parts HCl, is heated to 76° C. in a sealed container. The DEEDMAC stock is slowly transferred to the aqueous portion while under agitation from a turbine mixer at 72°–75° C. 1.2 parts of a 25% (aq.) $CaCl_2$ solution is dripped into the dispersion to transform it from a viscous paste to a thin fluid. The system is then high shear milled for two minutes at 55° C. using a rotor-stator probe element. Under moderate agitation, the system is brought to room temperature within five minutes by immersion in an ice bath.

The following ingredients are sequentially added to the product under moderate agitation at room temperature:

1.25 parts of a 40% solution of stabilizer polymer (per Gosselink; derived from dimethyl terephthalate/1,2-propylene glycol/methyl capped polyethylene glycol preferably comprising about 5 terephthalate units in the backbone and 40 EO units in the "tails");

A blend of 6.1 parts of a HCl;

Up to 1.35 parts Perfume;

0.1 parts Ammonium chloride;

Up to 0.5 parts CAREZYME solution (optional);

2.8 parts of a 25% aq. $CaCl_2$ solution.

Sufficient time of mixing is allowed to promote the diffusion of perfume into the DEEDMAC vesicles. This is proportional to the batch size. The order of addition of the above ingredients is critical to the physical stability of the final dispersion. The perfume addition should precede the $CaCl_2$. The polymer addition should precede the addition of chelant and preferably the other electrolytes. When pH-sensitive softeners are used, the chelant should be blended with acid or base close to the pH of the softener to avoid localized pH shifts which can impact softener stability and affect the viscosity stability of the product. The finished product contains 2.5% DETPA.

EXAMPLE II

When preparing a liquid product comprising the DEEDMAC softener and EDDS chelator, the following modification of Example I is used.

1. $MgCl_2$ is generally used instead of $CaCl_2$ in the composition. 1.0 parts of a 25% aq. solution of $MgCl_2$ is dripped into the hot dispersion prior to milling, and a equal amount of this salt is added as the final step in product making.
2. In place of DETPA/HCl addition, a blend of 3.8 parts of a 33% aq. NEDDS solution with 1.25 to about 1.50 parts of a 50% aq. $ZnCl_2$ solution are added to the product under moderate agitation after the stabilizing polymer addition.

The finished product contains 1.25% EDDS.

EXAMPLE III

A rinse-added liquid chelator composition with fabric softening properties is formulated as follows using biodegradable EDDS and a biodegradable fabric softener. The pH of the finished product, measured "as is" is 3.5.

| Ingredient | % (Wt.) |
|---|---|
| DEEDMAC | 25 |
| EDDS[S,S], Na salt | 1.25 |
| $ZnCl_2$ | 0.75 |
| Polymer* | 0.5 |
| Water and minors** | Balance |

*Synthesized from dimethyl terephthalate, 1,2-propylene glycol and methyl capped polyethylene glycol as disclosed by Gosselink, ibid.
**Perfume, electrolyte, acidulant.

EXAMPLE IV

A rinse-added liquid chelator composition comprising a biodegradable fabric softener and formulated at pH 3 to 3.5 to provide storage stability is as follows:

| Ingredient | % (Wt.) |
|---|---|
| DEEDMAC | 25 |
| DETPA, Na | 2.5 |
| KYMENE | 1.0 |
| Polymer* | 0.5 |
| Water and minors** | Balance |

*Polymer as in Example III.
**Perfume, electrolyte, acidulant.

Table 2 illustrates the fluidity and homogeneity of softener compositions generally of the foregoing type, and containing the chelating agents DETPA, EDDS, DETMP and NTA, respectively.

TABLE 2

| | | Viscosity 74° F. (23° C.) | |
|---|---|---|---|
| | % Stabilizer Polymer | Fresh | Aged |
| % DETPA | | | |
| 1.50 | 0 | 95 cp | 390 cp (7days) |
| 2.50 | 0 | 250 cp | Phase Separation within 1-day |
| 2.50 | 0.25 | 32 cp | 40 cp (15 days) |
| 2.50 | 0.50 | 28 cp | 36 cp (15 weeks) |
| % EDDS* | | | |
| 1.25 | 0.5 | 42 cp | 55 cp (1 week)<br>69 cp (3 weeks)<br>78 cp (6 weeks) |

*Product contains 0.63% $ZnCl_2$ and $MgCl_2$ in place of $CaCl_2$; viscosity measurement at ambient temperature.

| % DETMP | | | |
|---|---|---|---|
| 2.5 | 0.5–0.75 | — | 44–77 cp* |

*Fresh and over a period of 4 weeks at temperatures ranging from 40° F. (4° C.) to 74° F. (23° C.). At a storage temperature of 110° F. (47° C.) viscosities range from 44 cp to 294 cp over a 3-week period.

| % NTA | | | |
|---|---|---|---|
| 2.5 | 0.5 | — | 58–71* |

*Measured as with DETMP. At 110° F. (47° C.) viscosities range from 58 cp to 491 cp (3 weeks).

The compositions herein may optionally contain various other ingredients, including but not limited to: dyes; antifoams (typically, silicone antifoam such as Dow Corning 2210); preservatives such as KATHON; and the like. Such ingredients typically comprise from about 0.01% to about 1% of the total compositions herein. In order to avoid extraneous metal cations and electrolytes, the compositions are preferably formulated using deionized water. If alcohols such as ethanol are used, they typically comprise about 5%, or less, by weight of the compositions.

The compositions herein are intended for use by contacting the fabrics to be treated with an aqueous medium containing any of the foregoing compositions. Contact between the fabrics and the treatment solution can be conducted by any convenient method, including sprays, padding on, spot treatment or, preferably, by immersing the fabrics in an aqueous bath containing the compositions, e.g., a conventional aqueous rinse bath typically at about 70° F (20° C.) at a pH of about 6.5–8.0 for at least about 1 minute following an otherwise conventional laundering operation. Usage levels are conventional for fabric softeners, and will usually range from 1–20 mls, or higher, depending on the desires of the user and the fabric load and type being treated. Preferred compositions comprising a dialkylesterified ethyldimethyl ammonium salt as the fabric softener, ammonium chloride as a chlorine scavenger and a chelating agent provide exceptional fabric softening and color maintenance to fabrics treated therewith.

What is claimed is:

1. A liquid fabric softener composition, comprising:

(a) a stabilizing amount of a stabilizing agent which comprises a polymer having the formula:

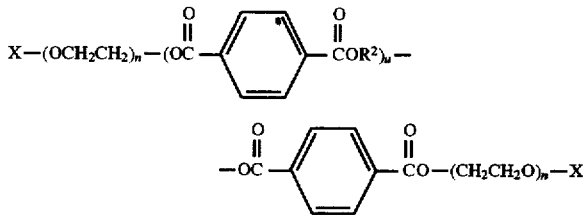

wherein $R^2$ is selected from the group consisting of 1,2-propylene, ethylene, or mixtures thereof; each X is $C_1$–$C_4$ alkyl; each n is from about 12 to about 43; and u is from about 3 to about 10;

(b) at least about 10%, by weight, of a cationic fabric softener selected from the group consisting of quaternary ammonium compounds or amine precursors herein having the formula (I) and (II), below.

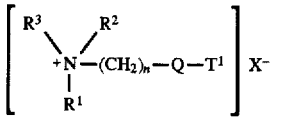

(I)

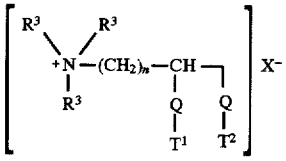

(II)

Q is —O—C(O)— or —C(O)—O— or —O—C(O)—O— or —$NR^4$—C(O)— or —C(O)— $NR^4$—; or mixtures thereof, e.g., an amide substituent and an ester substituent in the same molecule;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are each $C_{11}$–$C_{22}$ alkyl or alkenyl;

n and m are integers from 1 to 4; and $X^-$ is a softener-compatible anion;

(c) greater than about 1%, by weight, electrolyte; wherein said electrolyte includes from 1.25 to about 15%, by weight of the total composition, of water-soluble chelating agents selected from the group consisting of amino carboxylates, amino phosphonates, polyfunctionally-substituted aromatic chelating agents and mixtures thereof; and (d) a fluid carrier comprising water.

2. A composition according to claim 1 wherein the fabric softener is cationic and contains ester linkages.

3. A composition according to claim 2 wherein the fabric softener is a dialkylesterified ethyldimethyl ammonium salt.

4. A composition according to claim 1 which comprises from about 15% to about 35%, by weight of the fabric softener.

5. A composition according to claim 2 which encompasses from about 0.2% to about 1%, by weight, of the stabilizing agent.

6. A composition according to claim 1, wherein the electrolyte is a water-soluble organic compound which is a member selected from the group consisting of chelating agents antimicrobials, chlorine scavengers, and mixtures thereof.

7. A composition according to claim 1, comprising:

(a) from about 0.2% to about 1%, by weight, of said stabilizing agent;

(b) from about 20% to about 30%, by weight, of a cationic fabric softener;

(c) electrolytes in an amount greater than about 1%, by weight, of compositions;

and (d) a fluid carrier comprising water.

8. A composition according to claim 7 wherein the chelating agent is a member selected from the group consisting of diethylenetriamine-N,N,N',N",N"-pentakis(methane phosphonate), diethylenetriamine pentaacetate, nitrilotriacetate, and mixtures thereof.

9. A composition according to claim 7 wherein the chelating agent is ethylenediamine disuccinate and which additionally comprises water soluble zinc salts.

10. A composition according to claim 1 which additionally comprises ammonium chloride as a chlorine scavenger.

11. A composition according to claim 1 additionally comprises a cellulase enzyme.

* * * * *